US005387455A

United States Patent [19]

Hörsch

[11] Patent Number: 5,387,455

[45] Date of Patent: Feb. 7, 1995

[54] COMPONENT MADE OF RESINIFIED SPACE-LAYER FABRIC, AND A METHOD OF PRODUCING A LAGGING

[75] Inventor: Friedrich Hörsch, Ulm, Germany

[73] Assignee: Vorwerk & Co. Interholding GmbH, Wuppertal, Germany

[21] Appl. No.: 129,072

[22] PCT Filed: Mar. 25, 1992

[86] PCT No.: PCT/EP92/00659

§ 371 Date: Oct. 5, 1993

§ 102(e) Date: Oct. 5, 1993

[87] PCT Pub. No.: WO92/17661

PCT Pub. Date: Oct. 15, 1992

[30] Foreign Application Priority Data

Apr. 5, 1991 [DE] Germany ..... 91041441[U]

[51] Int. Cl.[6] ..... B32B 3/12

[52] U.S. Cl. ..... 428/116; 73/49.2; 139/384 R; 139/410; 139/420 C; 139/420 R; 156/71; 156/292; 156/293; 156/307.3; 220/454; 428/224; 428/225; 428/251; 428/257; 428/902

[58] Field of Search ..... 428/116, 117, 224, 257, 428/285, 251, 902; 139/384 R, 410, 420 R, 420 C; 156/148, 71, 282, 293, 307.3; 73/49.2, 49.3; 220/454

[56] References Cited

U.S. PATENT DOCUMENTS

| | | | |
|---|---|---|---|
| 3,481,427 | 12/1969 | Dobbs et al. | 181/33 |
| 4,330,811 | 5/1982 | Bordner | 361/212 |
| 4,840,828 | 6/1989 | Bottger et al. | 428/257 |
| 4,921,751 | 5/1990 | Wakahara et al. | 428/229 |
| 5,240,533 | 8/1993 | Bottger et al. | 428/257 |

FOREIGN PATENT DOCUMENTS

| | | |
|---|---|---|
| 0299308 | 1/1989 | European Pat. Off. . |
| 88110601.7 | 1/1989 | European Pat. Off. . |

*Primary Examiner*—James J. Bell
*Attorney, Agent, or Firm*—Martin A. Farber

[57] ABSTRACT

The invention relates to a structural part (1) consisting of a cured resinified spaced-layer fabric of industrial fibers such as glass fiber, aramid fiber, ceramic fiber or the like, having a first layer (2) and a second layer (3) which are liquid-tight and are spaced from each other by cross-pieces (11). In order to obtain a structural part which is suitable, in particular, also in connection with containers for easily inflammable and explosion-endangered substances such as for instance gasoline, the invention proposes that conductive threads (4, 5) which are incorporated in the spaced-layer fabric extend alternately between the layers (2, 3).

8 Claims, 3 Drawing Sheets

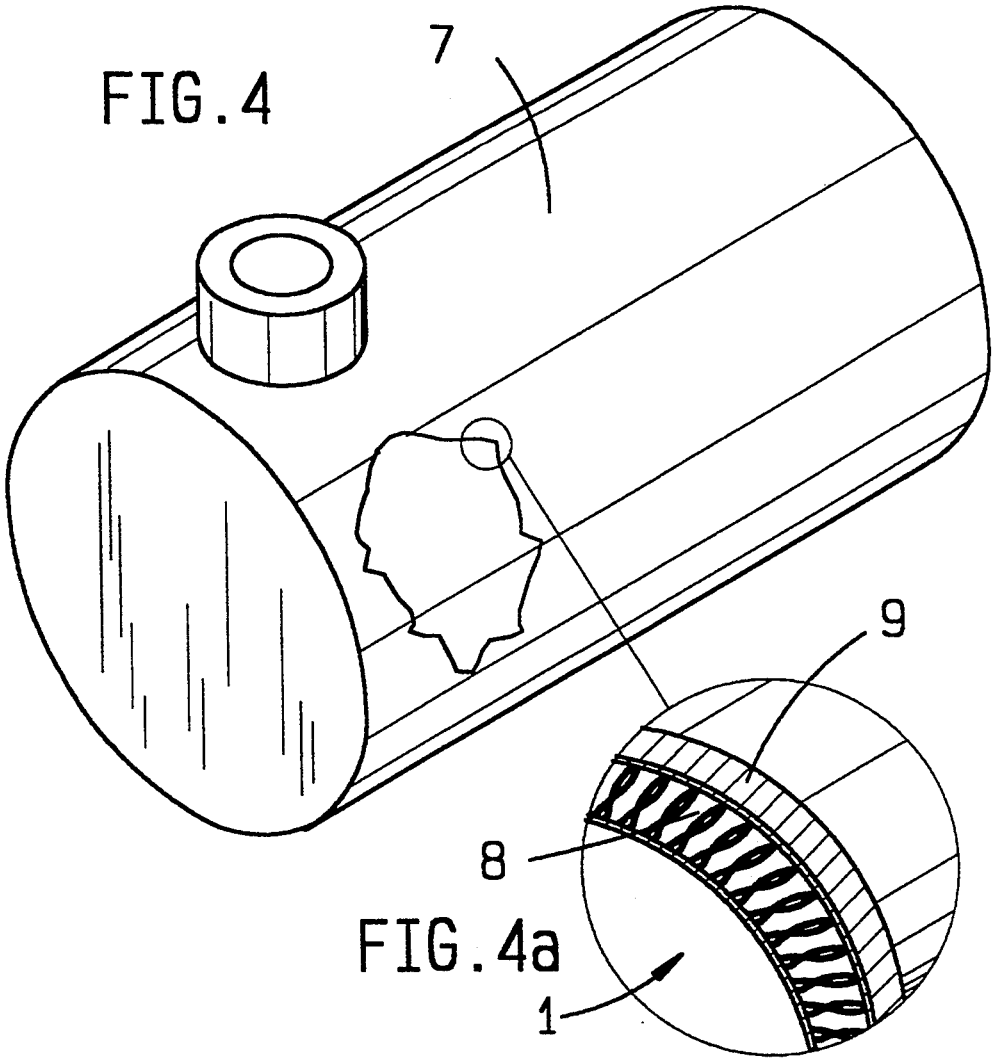
FIG.4
FIG.4a
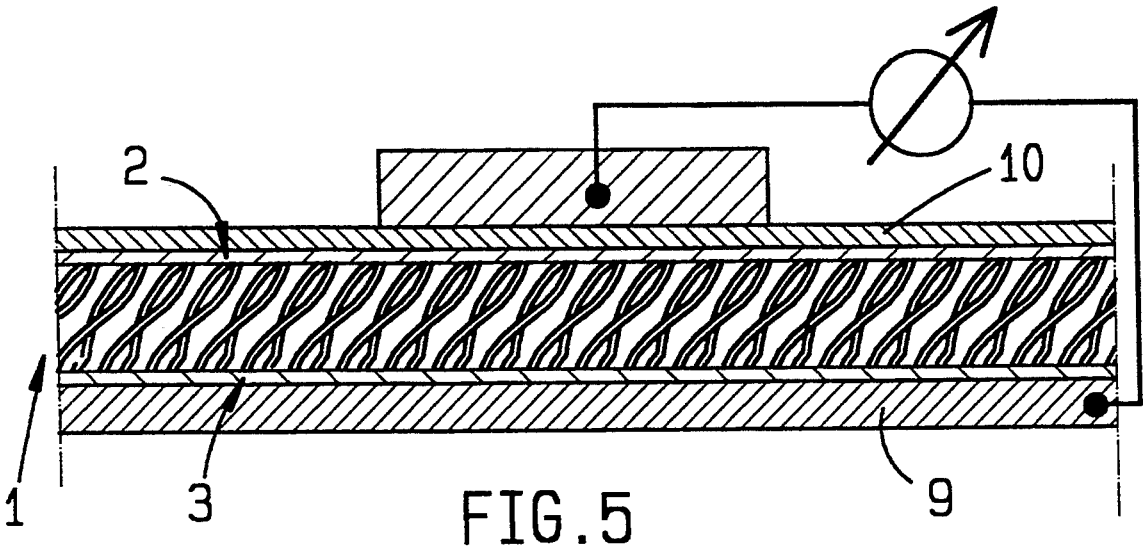
FIG.5

COMPONENT MADE OF RESINIFIED SPACE-LAYER FABRIC, AND A METHOD OF PRODUCING A LAGGING

The present invention relates first of all to a structural part consisting of a cured resinified spaced-layer fabric formed of a ductile fiber such as glass fiber, aramid fiber or the like, having a first layer and a second layer which are liquid-tight and are spaced from each other by cross-pieces.

Such a structural part is known, for instance from the European Patent Application 88 110 601.7. In addition to this, reference should also be had to U.S. Pat. No. 3,481,427.

In particular, the structural part known from the European Patent Application has proven its worth in many respects in practice. Thus, linings are also effected of hollow bodies, for instance tanks which are to be restored. Particularly in the case of tank farms, the safety requirements, however, are very high. On the one hand, the lining material must be resistant to the liquids stored in the tanks, for instance gasoline, and, on the other hand, easy inflammability or danger of explosion of such substances must be taken into account. In particular with regard to the latter requirement, a lining having a base of a spaced-layer fabric is not yet satisfactory in all respects.

Proceeding from the prior art described above, the object of the present invention is to provide a structural part based on a spaced-layer fabric which is suitable in particular also for containers for easily inflammable and explosion-endangered substances such as, for instance, gasoline.

This object is solved by the invention set forth in claim 1. It is directed at the fact that conductive threads which are incorporated in the spaced-layer fabric extend alternately between the layers. These conductive threads, for instance carbon threads, connect the two layers dependably in electrically conductive manner with each other. This means that any electrostatic charge of the container which may be present is discharged to the surface of the uppermost layer of fabric. By suitable measures it can thus be assured that practically no potential difference to ground is present. This measure surprisingly makes linings having a base of spaced-layer fabric also suitable for easily inflammable or explosive substances such as gasoline, for instance. As a further development, it is provided that the layers of the spaced-layer fabric are transparent of translucent in resinified state. This transparency first of all makes possible a simple verification as to whether the desired spacing of the lining is actually also fully established. Regions in which the spacing has not been established are differently colored, namely darker. Between the two layers a hollow space is formed which is passed through solely by the cross-pieces which connect the two layers together. If the inner layer facing the liquid or a tank wall has a leak for instance, liquid penetrates into the hollow space between the two layers, and this is recorded by a monitoring device.

The invention also relates to a method for developing a lagging, preferably an inner covering of a hollow body such as, in particular, a tank, this inner covering making the monitoring of leaks possible and can be used at the same time in the case of substances which are subject to fire or explosion. In this connection, the invention proposes the application of a conductive resin composition onto a container wall. By this resin composition, an electrically conductive spaced-layer fabric which is transparent or translucent after impregnation with resin and hardening of the resin is attached to the wall of the container. The lamination resin used for the impregnation of the spaced-layer fabric is preferably not made conductive by graphite or carbon fibers, in order to retain the transparency of the spaced-layer fabric laminate. Only in this way is its possibly visually to check the function of the hollow space before the application of further conductive layers. The resin composition first applied to the container wall can, in particular, also exhibit strong colorability, for instance be a bright red. This in order to utilize transparency of the fabric in the manner already explained in principle above. The spaced-layer fabric is in this connection preferably made of an industrial fiber, such as, for instance, glass fiber. In addition to this, the spaced-layer fabric has floatingly inserted conductive threads, such as, for instance, carbon threads. These conductive threads permit leakage monitoring, for instance by merely a resistance measurement. The conductive threads alternate between the individual layers, preferably uniformly over the length of the spaced-layer fabric. If now the hollow space between the layers within which otherwise only the support threads are present fills up with liquid as the result of a leak, the electric resistance will decrease because of a shortening of the conductive path which results therefrom. This, of course, also as a function of the electrical properties of the liquid, but here, merely for the sake of explanation, optimal conductivity is assumed. Even if the liquid which penetrates, for instance, into the hollow space is of poor electrical conductivity, a characteristic change will result in the resistance and this change in resistance can also be used in any event for the leakage monitoring. In its development, it is provided that the upper layer then is again covered with a resin of particularly good conductivity. It serves, on the one hand, for the sealing of the lagging and, on the other hand, also for reliable equality of electrical potential, which upper layer can then be grounded.

In addition, the invention also relates to a spaced-layer fabric itself, particularly to one having a base of pile fabric consisting on an industrial yarn such as, for instance, glass fiber. This spaced-layer fabric is characterized by a floatingly interwoven conductive thread which alternates between the layers. It is preferable that the conductive thread be interwoven in addition to a reinforcement thread of the spaced-layer fabric. As an alternative to this, the conductive thread can also be interwoven instead of a pile thread which in any event is present in the spaced-layer fabric. In addition to this, it is possible for the conductive thread, which is for instance a carbon thread, to be interwoven in part in binding-skipping fashion.

The invention is furthermore explained below in detail with reference to the accompanying drawings, which, however, merely show illustrative embodiments. In the drawing:

FIG. 4 shows by way of example, in perspective, a tank which is lined with a lagging having a base of a spaced-layer fabric;

FIG. 4*a* is an enlargement of a portion of FIG. 4;

FIG. 5 serves to explain the action of the spaced-layer fabric, based on a measurement of potential difference.

Figure 1:
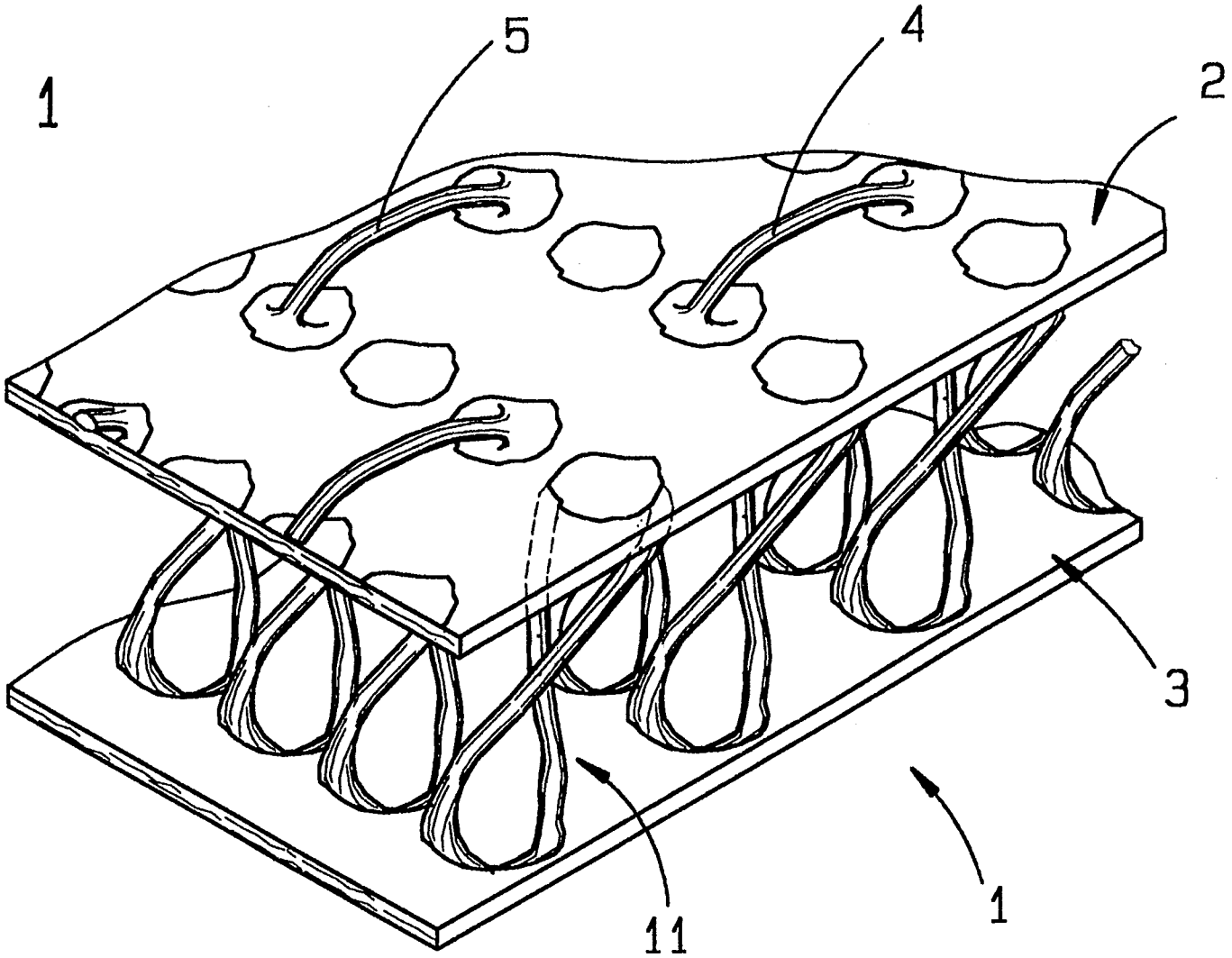
FIG. 1 is a perspective view of a structural part of a lagging consisting of a spaced-layer fabric having conductive threads.

Referring to FIG. 1, there is first of all shown a structural part 1 which consists of a cured, resinified pile fabric. For details, reference is had to the aforementioned European Patent Application 88 110 601.7. the disclosure of which patent is herewith included in its entirety in the present application.

By the curing resinification, two flat layers 2, 3 result. The structural part 1 is as a whole transparent. This is of great importance with respect to the possibility of verifying the spacing, as explained in detail above.

Figure 2:
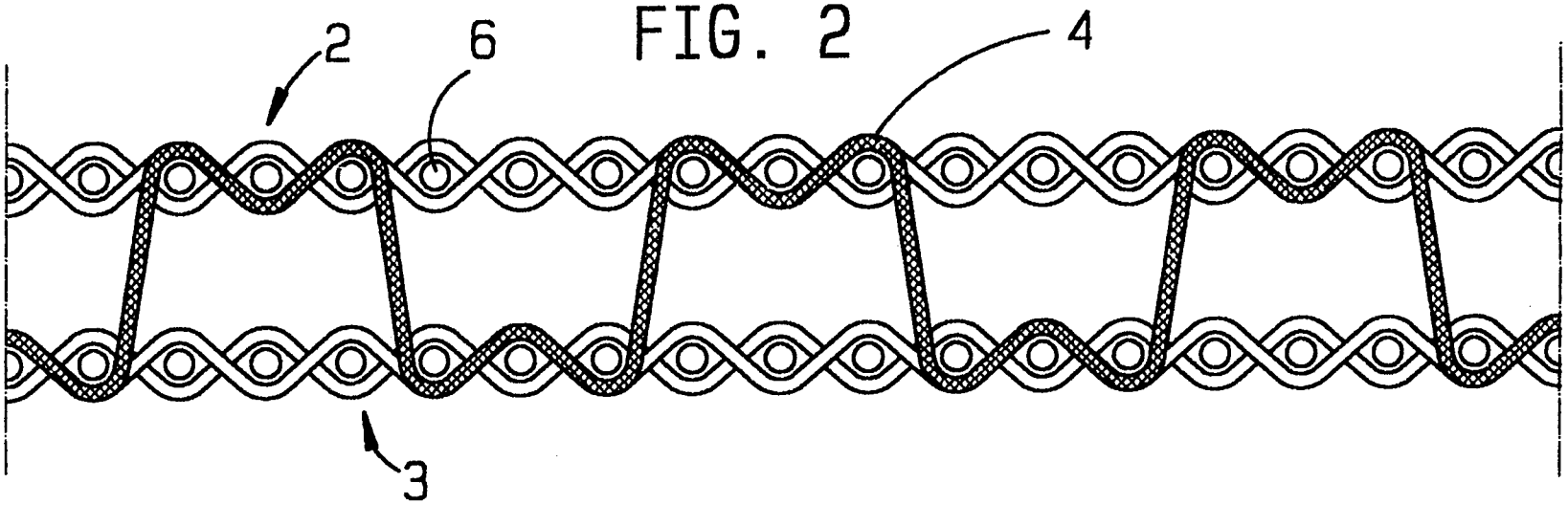
FIG. 2 shows an illustrative weave for the spaced-layer fabric.
Figure 3:
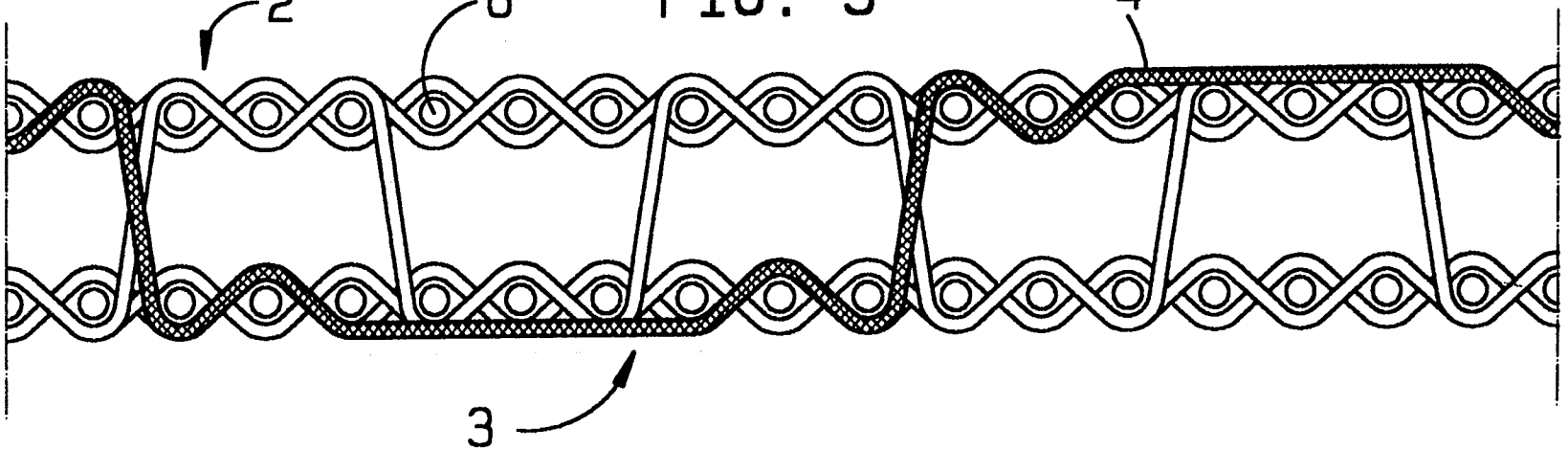
FIG. 3 shows another possible weave of the spaced-layer fabric.

As will be further described in detail with respect to FIGS. 2 and 3, conductive threads 4, 5 are incorporated in the fabric which forms the basis of the structural part. They may be carbon threads, while the fabric otherwise consists of glass fiber. However, they may also be non-conductive or substantially non-conductive fibers of ceramic fiber or the like. The conductive threads 4, 5, which may in principle also for instance be thin metal wires, alternate between the layers 2 and 3. In the embodiment shown, the threads 4, 5 replace a pile thread and therefore are furthermore completely integrated into the fabric structure.

Such a fabric is shown diagrammatically in FIG. 2. In this case also, the upper layer 2 and the lower layer 3 can be noted. The floating pile thread 4 consists in this case of a conductive thread. It is anchored by three filling threads 6 each in the upper layer 2 and the lower layer 3. The base fabric is a pile fabric. The conductive pile thread can be interwoven in addition to the pile threads which form the cross-pieces 11 (FIG. 1) or can replace (in part) such a pile thread.

The pile threads 6 are woven-in at a distance apart of 2 mm up to 20 mm or more. This can be effected with the same piles as used for the rest of the fabric. In order for the pile binding of the conductive threads to be independent of the other pile threads—if only individual pile threads are developed as conductive threads—it is advisable, however, to insert one or two separate piles. In this way, longer or shorter floatings can be obtained, as shown in particular in FIG. 3. Here, the pile thread is first of all anchored for instance in the lower layer 3 by means of two filling threads, whereupon it springs over five filling threads and is anchored in the lower layer by an additional two filling threads and then changes to the upper layer 2.

Referring to FIG. 4, the following procedure is used for the development of the lagging. A container, in this case a tank, is covered on its inside with the spaced-layer fabric 1. First of all, the inner surface 8 of the container wall 9 is coated with a resin composition of good conductivity. The spaced-layer fabric is pressed into this resin composition. By the conductive addition substances present in the resin, for instance carbon particles, an electrically conductive connection to the spaced-layer fabric is created. Thereupon, as already described above, metallic or carbon pile fabrics 4 which are introduced in raster or linear shape are then interwoven in the spaced-layer fabric, they connecting the two cover fabric layers electrically to each other. After the application of the fiber and possible initial curing in the region of vertical and overhanging parts of the tank, the fabric is impregnated with a transparent lamination resin. An excess of lamination resin can be squeezed out or a suitably defined quantity can be introduced immediately. In each case, the spaced-layer fabric automatically moves back. An initial curing of the lamination resin is awaited and the inner wall (inner layer) is then possibly thickened by further layers. For this there is also used a fabric provided, in raster shape, with conductive threads. As final layer, a strongly conductive cover resin is again applied in order to make the surface of the tank wall of particularly good electrical conductivity. The hollow space which is formed on basis of the spaced-layer fabric must be capable of being visually checked. As a result of the above-mentioned transparency or translucency of the fabric, regions can be noted where, for instance, the hollow space may possibly not have formed, where the layers for instance rest against each other, or where the hollow space is filled with resin.

FIG. 5 shows the success which can be obtained with the invention described. The potential difference between the container wall 9 and a top layer of the inner wall 10 can be easily measured. By the procedure described, a resistance is produced which is $<10^5$ ohm. For instance, for inflammable goods of danger classes AI, AII and B, it is stipulated that the resistance is to be $<10^8$ ohms. This limit is therefore clearly not reached.

The features of the invention disclosed in the above specification, the drawing and the claims can be of importance, both individually and in any desired combination, for the reduction to practice of the invention. All features disclosed are essential to the invention. The disclosure of the corresponding/accompanying priority papers (copy of the prior application) are herewith also included in their entirety in the disclosure of the present application.

I claim:

1. A structural part consisting of a cured, resinified spaced-layer fabric consisting of industrial fibers drawn from the class of non-conductive or nearly non-conductive fibers consisting of glass fibers, ceramic fibers or the like, the structural part having a first layer and a second layer which are liquid-tight and are spaced apart by cross-pieces, and conductive threads, wherein the conductive threads are incorporated in the spaced-layer fabric and extend alternately between the layers.

2. A structural part according to claim 1, wherein that the layers are transparent or translucent, at least in their resinified state.

3. A method of developing a lagging, operable as an inner cover of a hollow body including a tank, wherein the inner cover permits leakage monitoring and can at the same time be used in the case of substances subject to fire or explosion; the method comprising steps of attaching an electrically conductive, transparent/-translucent spaced-layer fabric to a container wall by application of a conductive resin composition to the container wall;

impregnating the spaced-layer fabric with a resin composition which retains the transparency/translucence and leads to a curing of the spaced-layer fabric; and providing the spaced-layer fabric with conductive connecting threads which alternate between layers of the fabric.

4. A method wherein the fabric has an upper layer, the method further comprising a stem of covering the upper layer again with a resin of good conductivity.

5. A spaced-layer fabric, including a pile fabric, comprising an industrial yarn drawn from a class of fibers consisting essentially of glass fiber, aramid fiber, ceramic fiber or the like, wherein the fiber has a conductive thread which is interwoven in floating fashion and alternates between a plurality of layers of the fabric.

6. A spaced-layer fabric according to claim 5, further comprising a reinforcement thread of the spaced-layer fabric, and wherein the conductive thread is interwoven in addition to the reinforcement thread.

7. A spaced-layer fabric according to claim 5, wherein a layer of the fabric is provided with bindings, and the conductive thread is interwoven in part skipping over individual ones of the bindings.

8. A spaced-layer fabric according to claim 6, wherein a layer of the fabric is provided with bindings, and the conductive thread is interwoven in part skipping over individual ones of the bindings.

* * * * *